US007370988B2

(12) United States Patent
Hagen

(10) Patent No.: US 7,370,988 B2
(45) Date of Patent: May 13, 2008

(54) IN-GRADE LIGHT FIXTURE HOUSING AND HYDROLOGICAL BARRIER PLATE FOR USE THEREIN

(75) Inventor: Douglas W. Hagen, Coarsegold, CA (US)

(73) Assignee: B-K Lighting, Inc., Madera, CA (US)

( * ) Notice: Subject to any disclaimer, the term of this patent is extended or adjusted under 35 U.S.C. 154(b) by 2 days.

(21) Appl. No.: 11/219,455

(22) Filed: Sep. 2, 2005

(65) Prior Publication Data

US 2005/0286245 A1 Dec. 29, 2005

Related U.S. Application Data

(63) Continuation of application No. 10/443,381, filed on May 22, 2003, now Pat. No. 7,033,038.

(60) Provisional application No. 60/383,342, filed on May 24, 2002.

(51) Int. Cl.
*F21S 8/00* (2006.01)

(52) U.S. Cl. ..... 362/153; 362/153.1; 362/267; 362/364; 362/457; 174/37; 174/554

(58) Field of Classification Search ..... 362/101, 362/153, 153.1, 267, 274, 457, 96, 158, 364, 362/296, 300, 303, 305, 341, 347, 243, 245, 362/247, 516; 174/37, 52.3, 554
See application file for complete search history.

(56) References Cited

U.S. PATENT DOCUMENTS 4,295,675 A * 10/1981 Niskin ..... 292/256.6
5,207,499 A 5/1993 Vajda et al. ..... 362/96
5,727,873 A * 3/1998 Tyson ..... 362/294
5,743,622 A 4/1998 Ibbitson et al. ..... 362/153.1
5,842,771 A 12/1998 Thrasher et al. ..... 362/101
5,887,966 A 3/1999 Eissner et al. ..... 362/153.1
5,908,236 A 6/1999 Llucken et al. ..... 362/364
6,068,384 A * 5/2000 Tyson et al. ..... 362/153.1
6,175,487 B1 * 1/2001 McCartney et al. ..... 361/674
6,425,678 B1 * 7/2002 Verdes et al. ..... 362/244
2002/0044443 A1 4/2002 Kira et al.
2003/0048634 A1 * 3/2003 You et al. ..... 362/153.1

* cited by examiner

*Primary Examiner*—Sharon E. Payne
*Assistant Examiner*—Mary Zettl
(74) *Attorney, Agent, or Firm*—Koppel, Patrick, Heybl & Dawson

(57) ABSTRACT

A hydrological barrier plate for in-grade light fixture housings and a housing for use with light fixtures to prevent water entry into the water sensitive compartments of the light fixture. The barrier plate has a plate body with an opening in which is sealably disposed an anti-syphon wire pass-through valve for electrically connecting the components on one side of the barrier plate with the wires in the junction box on the opposite side of the barrier plate. The barrier plate is sealed around its outer edge against the housing wall. The pass-through valve is configured to prevent water from wicking along the wires and to prevent water from passing around the valve. The barrier plate is installed without tools and an effective seal is easily obtained. Using the barrier plate, water is prevented from migrating between the junction box and the primary housing compartments of the housing.

18 Claims, 6 Drawing Sheets

FIG. 2
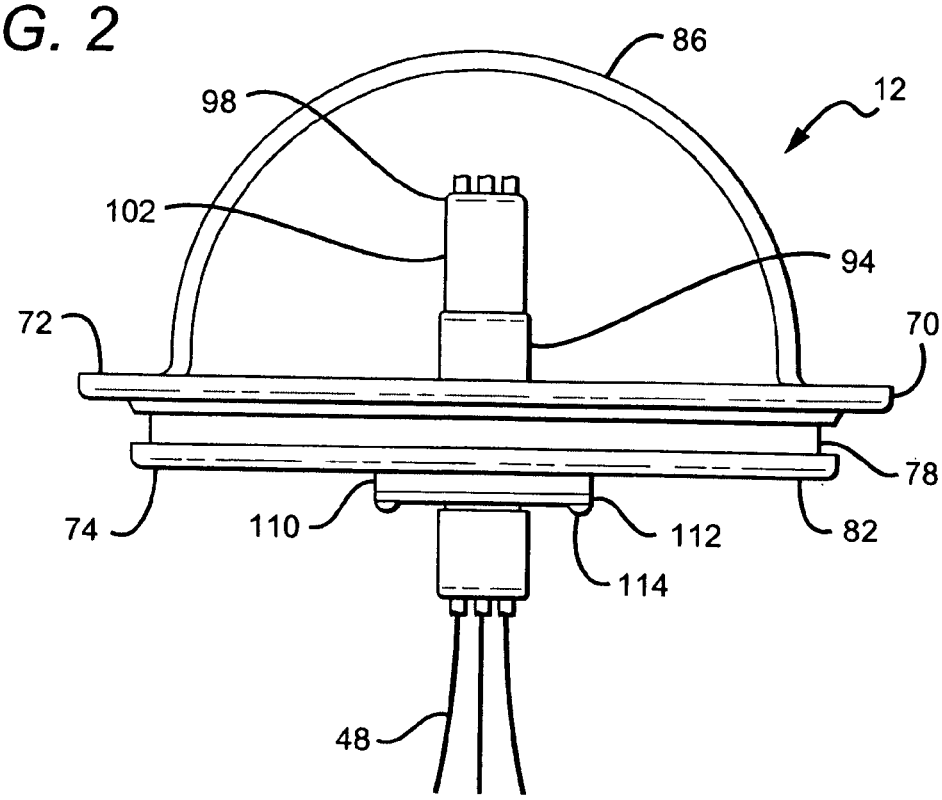
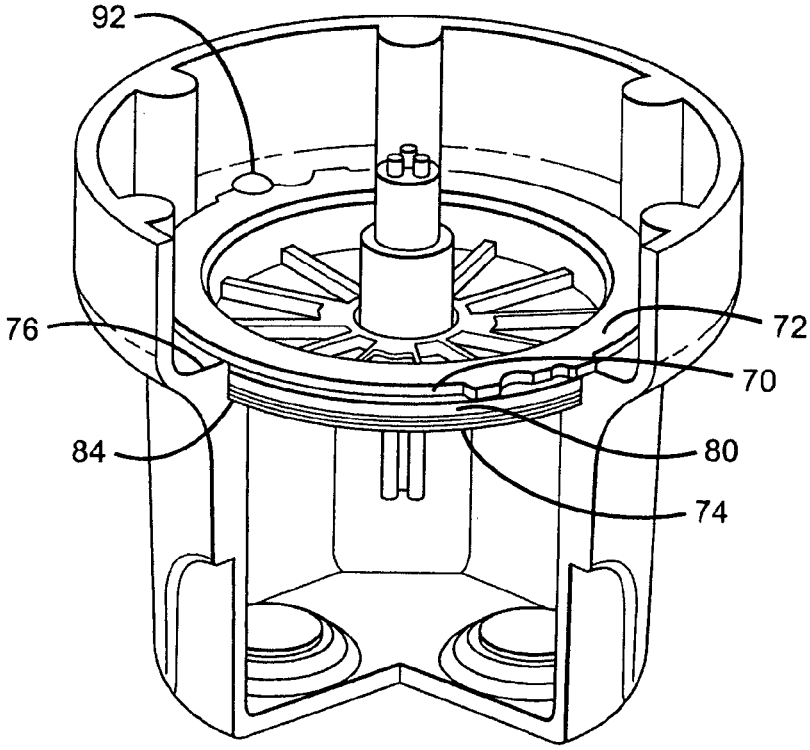
FIG. 3

IN-GRADE LIGHT FIXTURE HOUSING AND HYDROLOGICAL BARRIER PLATE FOR USE THEREIN

This application is a continuation of patent application Ser. No. 10/443,381 filed on May 22, 2003 now U.S. Pat. No. 7,033,038, and claims priority of that application.

This application claims the benefit of U.S. Provisional Application No. 60/383,342, which was filed on May 24, 2002.

BACKGROUND OF THE INVENTION

1. Field of the Invention

The present invention relates generally to light fixtures and devices used therein to prevent water intrusion into the more water sensitive areas of a light fixture. In particular, the present invention relates to sealing mechanisms utilized in housings for in-grade or below grade light fixtures to prevent water from entering the electrically sensitive areas of the light fixture. In even more particularity, the present invention relates to a hydrological barrier plate that interacts with a light fixture housing to prevent water from entering water sensitive areas of the light fixture.

2. Description of the Related Art

There are many types of light fixtures that are used for many different purposes, including indoor and outdoor illumination and decoration. One type of light fixture is commonly referred to as an in-grade light fixture due to all or part of the light fixture being located in the ground at or slightly above the level of the ground surface, whether earth or covered ground surfaces such as concrete, asphalt, wood or the like. Typically, these light fixtures are used to illuminate walls, columns, flags, trees, signs and other objects. A recessed in-grade light fixture can be used to illuminate a path along the ground and the area near the path. The typical in-grader light fixture has a glass lens component which is attached to the top of a housing that contains the various electrical components that are used to power and operate the lamp portion of the light fixture within the housing. Another type of light fixture having an underground component utilizes a mounting system mounted to the top of the below ground housing. The mounting system is connected to a separate lamp housing, usually allowing pivotal rotation of the lamp housing to aim the lamp at a desired location. Both of these types of fixtures can utilize housings that are configured to contain a power supply, power converters, transformers, aiming brackets for the lamp and other components. In order to hold all these materials, the housings extend relatively deep (i.e., 14 to 16 inches) into the ground. The housing may be configured into separate compartments for the various internal components.

As is known in the art, the electrical power for operating the lamps and light fixture components is typically brought to the underground housing by wiring contained in an outer protective conduit line that attaches to the housing at a junction box having a wiring compartment for wiring the light fixture to the supply of electricity. Ideally, the conduit lines are sealed from the environment so water cannot enter into the conduit such that when the conduit is connected to the housing, the system is sealed against water intrusion into the junction box and the remaining housing. However, as is well known by those in the lighting industry, water still finds a way into the junction box and the remaining housing. Installation problems, kinks in the conduit shielding or other problems allow water to migrate inside the conduit and wick along the wire to the junction box and then collect inside the housing. The most common problems resulting from water inside the housing include corrosion, electrical shorts, shortened life of the ballast (power converter) or transformer and shortened lamp life. In addition, water entry into the electrically sensitive areas can create risk of electrocution for those working on the housing.

The typical in-grade light fixture housing is designed to have the conduit attach to the housing at a junction box compartment that is located at or near the bottom of the housing or to the side of the housing. The wires from the conduit enter into-the junction box, which can be the lower compartment of a vertical configured housing or a separate side housing out-side the primary housing. Although the junction box of the typical in-grade fixture is designed to be hydrologically isolated from the remaining housing, water is generally able to enter the junction box and the primary compartment of the housing. Depending on the design of the components inside the housing, this invasion of water can damage the more sensitive electrical components contained therein. The typical mechanism for water to enter the primary compartment of the housing is for the water to wick along the wires and past any devices used to isolate the junction box compartment.

To avoid these problems, most light fixture manufacturers utilize, either singularly or in combination, "watertight" wire connectors for connecting the wires together in the junction box compartment and/or sealing compound around the wires in the junction box compartment. Some light fixture manufacturers utilize a "watertight" wire or cord connector that is designed to prevent water from moving along the outside of the wire. Unfortunately water is usually still able to enter the primary compartments via the wire, typically inside the wire (which the connector is not designed to prevent) along the cardboard packing material used inside the wire insulation. Other light fixture manufacturers recommend the person installing the light fixture pour a "sealing compound", such as silicon potting compound, around the wires in the junction box to encase the wires in the compound so as to prevent water from passing through the junction box into the primary housing compartment. Problems with these compounds include having to rely on the contractor to accurately and properly place the compound to obtain an effective sealing and the likelihood that there will be air pockets inside the junction box that will allow water to pass.

The typical cover plate utilized to seal off the junction box compartment from the primary compartment is threaded into or attached to (i.e., with screws or other connectors) the housing and has one or more sealing mechanisms, such as o-rings or gaskets, near the outer edge of the cover plate and a wire pass-through device to allow the electrical power to pass to the components in the primary housing compartment. Heretofore, the o-rings or gaskets used to provide the seal between the cover plate and the housing are axially compressed by the action of the threads or connectors used to connect the cover plate to the housing. One major disadvantage of this type of sealing mechanism is that the effectiveness of the seal is dependent on the person threading or attaching the cover plate to the housing. If the cover plate is not properly threaded or attached, it will fail to prevent water passage into or from the junction box. Another disadvantage of the typical in-grade light fixture housing is that it can be very difficult to properly thread or attach the cover plate to the housing and very difficult to ensure that a proper seal is obtained. The inventors are aware of some manufacturers that utilize up to ten o-rings to obtain the desired seal. Despite this effort, water still wicks along the wire from the junction box compartment into the primary compartment.

Although the goal of in-grade light fixtures is to have the junction box compartment remain dry, generally all light fixture manufacturers know that in reality some amount of water will likely get inside that compartment due to a failure to completely seal the conduit system. As a result, the real goal is to prevent any water that collects inside the junction box from invading the other, more sensitive areas of the light fixtures where it can cause immediate or long term damage. As described above, the known existing art show the broad concept of attempting to prevent water intrusion into the primary housing compartments. For any housing to effectively keep water out of the housing, it must utilize a relatively simple to use and cost efficient mechanism. None of the known light fixture housing or sealing devices, whether individually or in all appropriate combinations, comprise a relatively inexpensive to manufacture, easy to operate and fully effective mechanism of keeping water from the primary compartments of a light fixture housing. Specifically, the known prior art does not disclose a sealed in-grate light fixture or a hydrological barrier plate that prevents water intrusion into the primary housing compartment. What is needed is a housing that is more effective at preventing water intrusion into the primary electrical compartments of the housing and a hydrological barrier plate for use in such a housing that effectively stops water from passing from the junction box to the primary housing compartments.

SUMMARY OF THE INVENTION

The in-grade light fixture housing and hydrological barrier plate for use in the housing of the present invention provides the benefits and solves the problems identified above. That is to say, the present invention provides a hydrological barrier plate and a housing using such a plate for keeping water out of the water-sensitive areas of the light fixture housing. Depending on the configuration of the housing (i.e., whether water is allowed to pass-through the primary housing or water is kept out of the primary housing), the barrier plate of the present invention either prevents water from entering the junction box from the housing and conduit or prevents any water that does get into the junction box from passing through to the primary housing portion. In one arrangement, the lighting components are placed vertically in the housing with the junction box compartment at the lowest level of the housing so the barrier plate isolates any water that gets into the housing from the conduit lines in the junction box. In another configuration, the junction box is in a secondary housing located along the side of the primary housing and the primary housing is configured to be either dry or pass-through.

In a preferred embodiment of the present invention, the hydrological barrier plate is used with light fixtures, particularly in-grade light fixtures, having a housing enclosing the electrical components that make up the light fixture. The barrier plate of the preferred embodiment of the present invention has a plate body with a first side, a second side, outer edge and a seal receiving portion located between the first side and the second side of the plate body. The outer edge of the plate body should be sized and configured to abut a plate ledge positioned in the housing to receive the plate body. The plate body has an opening interconnecting the first side and the second side of the plate body. At least a portion of a wire pass-through valve, which comprises a receptacle portion and a mateable plug portion, is sealably disposed in the opening. In the preferred embodiment, the receptacle portion is disposed in the plate body opening. At least one sealing member, such as an o-ring, is disposed in a seal receiving portion of the plate body and is configured to sealably abut the wall of the housing in a radial compression relationship when the outer edge of the plate body tightly abuts the plate ledge. In the preferred embodiment, the barrier plate is rotated under one or more pins to "lock" the barrier plate in place to prevent the barrier plate from being unseated. The pass-through valve is configured to have a first portion and a second portion with the first portion extending from the first side of the plate body and the second portion extending from the second side of the plate body. In this configuration the receptacle portion is disposed in the first portion and one or more wires, configured for attachment to a supply of electrical power, extends from the second portion. Also in the preferred embodiment, the pass-through valve further comprises a second sealing member and a plate member, with the sealing member integral with the pass-through valve and the plate member configured to sealably abut the second sealing member against the plate body using one or more connectors. The preferred embodiment of the barrier plate also includes a handle attached to the plate body to aid in seating the barrier plate and in the placement and removal of the barrier plate.

Another configuration of the present invention, includes a housing for use with in-grade light fixtures that has one or more water sensitive electrical components. In the preferred embodiment, the housing includes a junction box compartment for receiving the electrical wires that are connected to the source of electrical power and a primary housing compartment for enclosing the light fixture and/or water sensitive electrical components. In the preferred embodiment, the primary housing compartment of the housing has a plate ledge configured to receive a hydrological barrier plate that is either horizontally or vertically disposed in the housing between the junction box compartment and the primary housing compartment. As set forth above, the barrier plate can comprise a plate body having an opening therethrough, a wire pass-through valve sealably disposed in the opening and a seal receiving portion with at least one sealing member (i.e., o-ring). The sealing member is configured to sealably abut the housing when the plate body abuts the plate ledge. The preferred pass-through valve has a first portion and a second portion, with a receptacle in the first portion extending from the first side of the plate body and one or more wires from the second portion extending from a second side of the plate body for attachment to the wires from the supply of electrical power. The preferred pass-through valve has a second sealing member and a plate member configured to sealably abut the second sealing member against the plate body. One or more connectors can be used to connect the plate member to the plate body. The second sealing member can be made integral with the pass-through valve. A handle can attach to the plate body for raising, lowering and twisting the plate body in the housing.

Accordingly, the primary objective of the present invention is to provide an in-grade light fixture housing that effectively prevents water entry into the water sensitive areas of the light fixture.

It is also a primary objective of the present invention to provide a hydrological barrier plate for use in light fixture housings that prevents passage of water and other fluids from one part of the light fixture housing to the water sensitive areas of the light fixture housing.

It is also an important objective of the present invention to provide a light fixture housing having a junction box hydrologically isolated from the primary section of the light fixture housing.

It is also an important objective of the present invention to provide a hydrological barrier plate that provides an effective seal on its outer edge and prevents water wicking along the electrical wires that pass between the junction box area of the housing and the primary housing.

It is also an important objective of the present invention to provide a hydrological barrier plate that utilizes a wire pass-through device having anti-siphon capabilities to hydrologically isolate one part of the light fixture housing, such as the junction box, from the electrically sensitive areas of the housing.

The above and other objectives of the present invention will be explained in greater detail by reference to the figures and the description of the preferred embodiment which follows. As set forth herein, the present invention resides in the novel features of form, construction, mode of operation and combination of parts presently described and understood by the claims.

BRIEF DESCRIPTION OF THE DRAWINGS

In the drawings which illustrate the best modes presently contemplated for carrying out the present invention:

FIG. 2 is a side view of the preferred embodiment of the hydrological barrier plate of the present invention;

FIG. 3 is an isolated partial cut-away side view of the positioning of the hydrological barrier plate inside the housing of the present invention;

DETAILED DESCRIPTION OF THE INVENTION

With reference to the figures where like elements have been given like numerical designations to facilitate the reader's understanding of the present invention, and particularly with reference to the embodiment of the present invention illustrated in FIGS. 1 through 9, the preferred embodiments of the present invention are set forth below. The enclosed figures and drawings are merely illustrative of the preferred embodiments and represent several different ways of configuring the present invention. Although specific components, materials, configurations and uses are illustrated, it should be understood that a number of variations to the components and to the configuration of those components described herein and in the accompanying figures can be made without changing the scope and function of the invention set forth herein.

Figure 1:
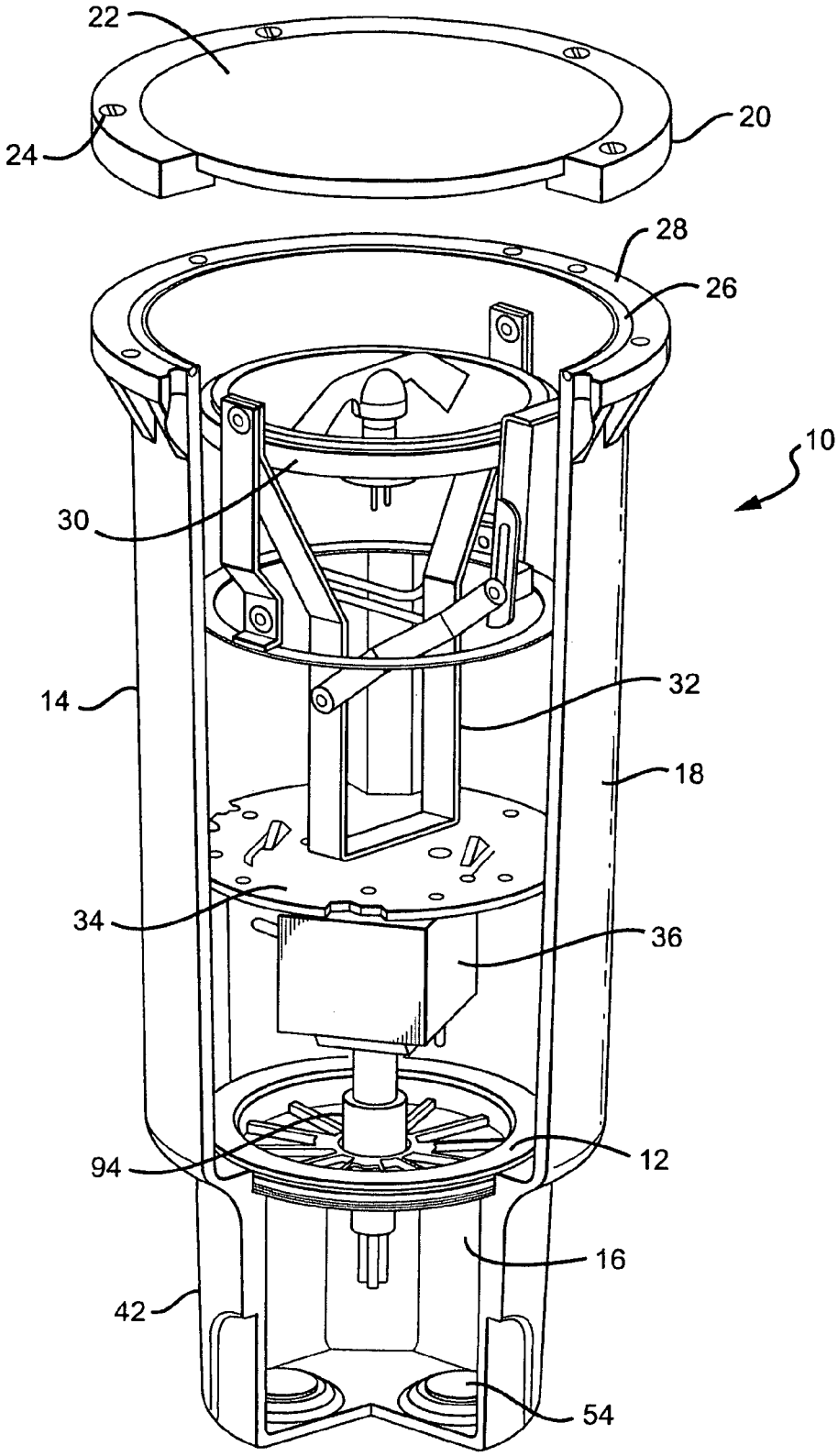
FIG. 1 is a partial cut-away side view of a preferred embodiment of the light fixture of the present invention showing placement of the hydrological barrier plate in relation to the principal components of the fixture.
Figure 4:
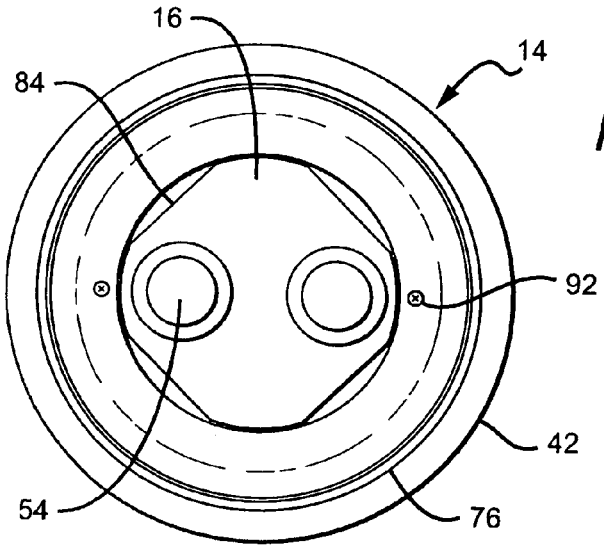
FIG. 4 is an elevation view of the present invention taken through the housing immediately above where the hydrological barrier plate would be located.

An in-grade light fixture for use with the present invention is shown generally as 10 in the accompanying figures. The preferred embodiment of the light fixture 10 of the present invention, as illustrated in FIG. 1, generally comprises a hydrological barrier plate 12 in the housing 14 to separate the junction box 16 from the primary housing compartment 18. Housing 14 is normally made from a corrosion-free or corrosive resistant material that is suitable for the location in which light fixture 10 will be used, including certain metals, plastics and composites. One such material is a high strength, bulk molding polyester compound that is glass reinforced, flame retardant and ultraviolet light stabilized. As best shown in FIG. 1, the typical in-grade light fixture 10 has a faceplate 20 with glass lens 22 that is attached to housing 14 with one or more connectors, such as screws 24. An o-ring 26, such as a high temperature silicone o-ring, or other sealing mechanism is disposed between faceplate 20 and the upper edge 28 of housing 14 to provide a seal for the top of fixture 10. When attached to housing 14, lens 22 permits light from lamp 30 to pass therethrough to provide the desired illumination effect. Lamp 30 can be attached to an aiming bracket 32 to allow the light from lamp 30 to be directed as desired. Aiming bracket 32 can be made out of stainless steel or other suitable materials and configured to allow rotation or pivoting in both the vertical and horizontal directions. A separation plate or tray 34 can be used in the upper compartment 18 to separate the low voltage transformer 36 (in FIGS. 1 and 7) or the high power factor ballast 38 (in FIG. 8). An optical quick disconnect 40 (FIGS. 7 and 8) can be used to connect the wiring from transformer 36 or ballast 38 to the wiring leading to lamp 30 (FIG. 7) or lamp 64 (FIG. 8).

Figure 7:
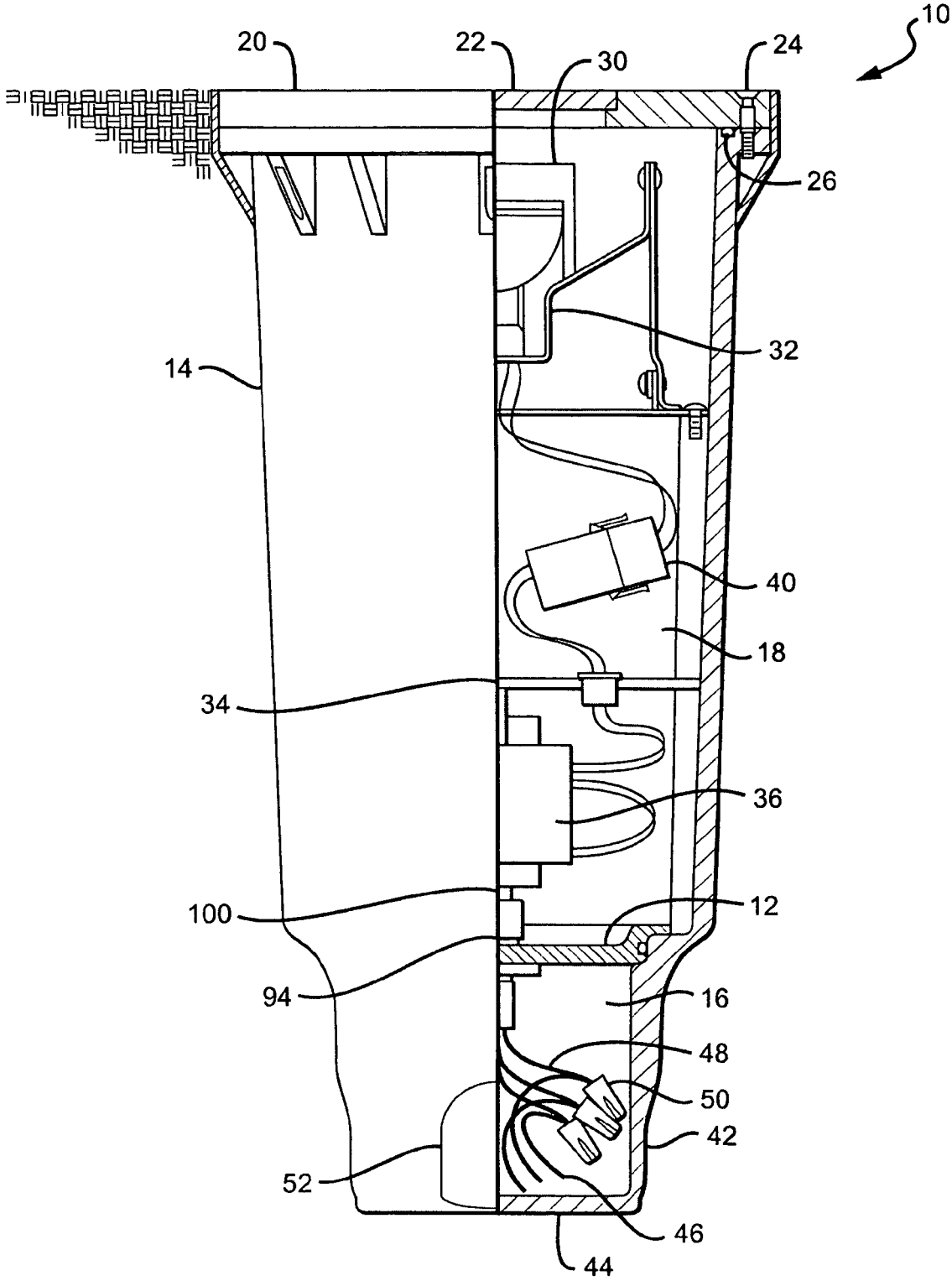
FIG. 7 is a cut-away side view of an in-grade light fixture using the hydrological barrier plate of the present invention.
Figure 9:
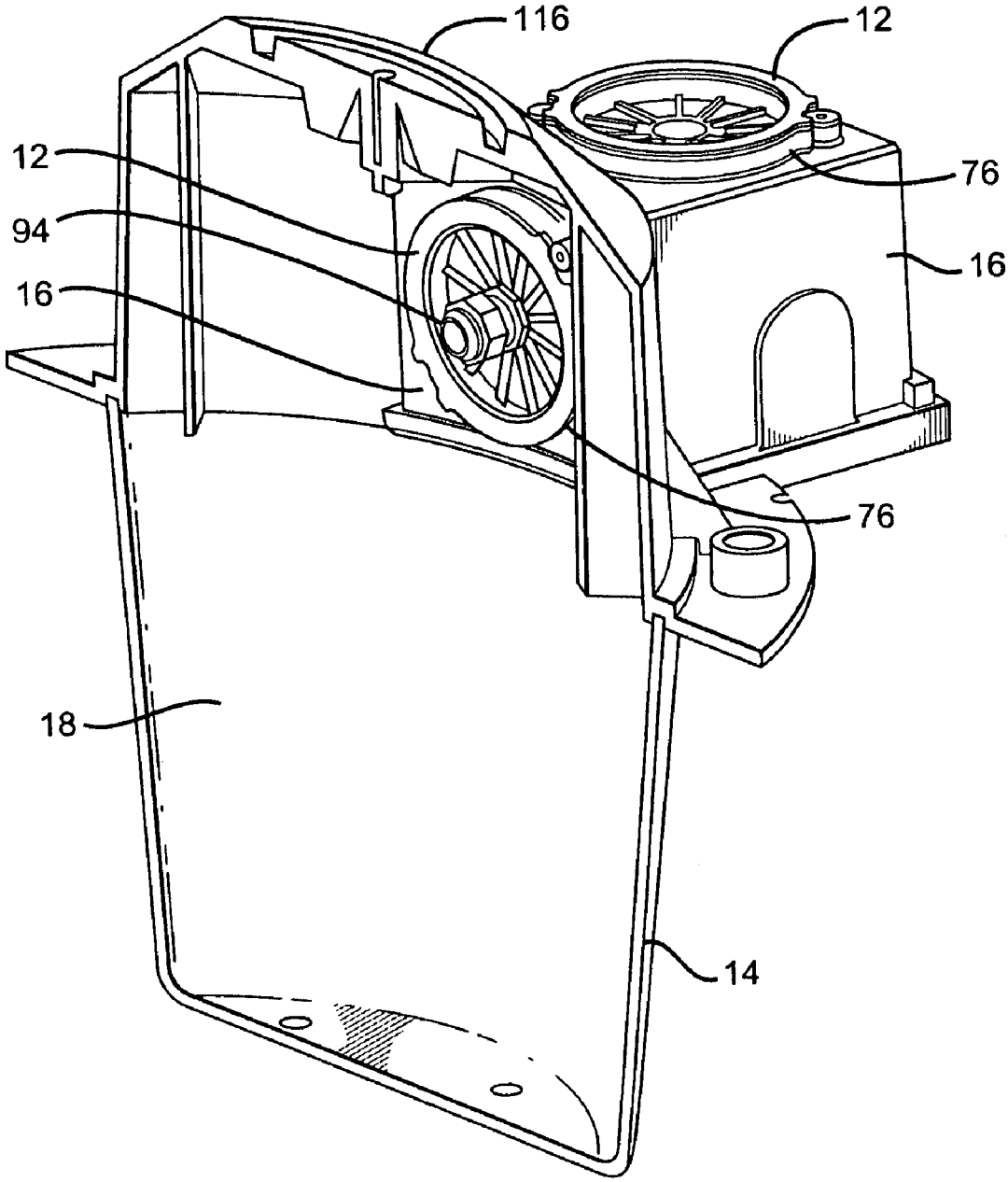
FIG. 9 is a cut-away view of a light fixture having the junction box attached to the side of the primary housing showing use of a hydrological barrier plate with and without a pass-through valve.

As best shown in FIG. 7, junction box 16 is formed by the sides 42 and bottom 44 of housing 14 and barrier plate 12 encloses the connections for power wiring 46 connected to fixture wiring 48 (as discussed in more detail below and as shown in FIG. 9, junction box 16 can also be positioned on the side of primary housing 18). Wires 46 and 48 are joined by wire connectors 50. Although, as is well known in the industry, a variety of connectors can be utilized for wire connectors 50, the preferred type of connectors are water-tight wire nuts (as opposed to standard wire nuts). The inventors have found that a particularly good connector for use with fixture 10 and barrier plate 12 of the present invention is the wire connectors made by King Safety out of St. Louis, Mo., referred to as their King Waterproof connectors, which have a viscous silicone material inside to prevent water from entering the open ends of the fixture wires 48 and wicking up wires 48. In sue with the preferred embodiments of the present invention, the King Safety waterproof nuts assist in keeping water out of the upper housing 18 of fixture 10. As shown in FIGS. 1 and 7, conduit attachment locations 52 are provided on the sides 42 of housing 14 in the area of the junction box 16 and female conduit entries (knockouts) 54 are provided on the bottom 44 of housing 14 for connecting the conduit (not shown) that carries power wiring 46 from the source of electrical power (also not shown).

Figure 8:
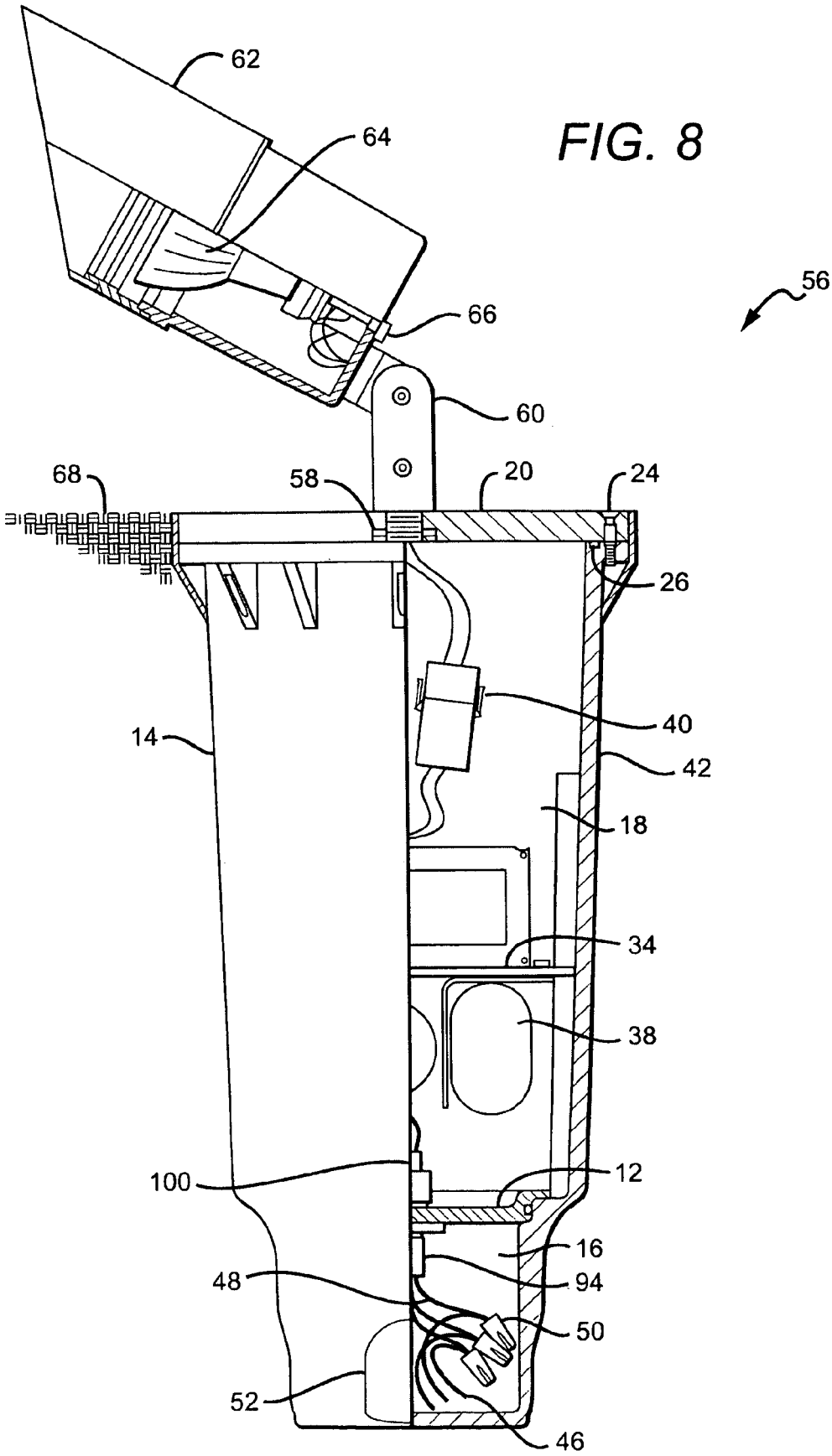
FIG. 8 is a cut-away side view of a light fixture having an above-ground lamp using the hydrological barrier plate of the present invention.

The housing 14 having barrier plate 12 of the present invention can be utilized with the light fixture 10 shown in FIGS. 1 and 7 having lens 22 that is at or slightly above the ground level, with in-grade light fixture 56 shown in FIG. 8, and with the light fixture housing 116 shown in FIG. 9. The faceplate 20 of the light fixture 56 does not have lens 20. Instead it has locknut 58 or other type of connector to connect to a mounting assembly 60 for mounting an above-ground light fixture housing 62 enclosing lamp 64. Preferably, mounting assembly 60 is of the type suitable for use with sealed light systems, as set forth in U.S. Pat. No. 6,161,948. The locknut 58 and mounting assembly 60 can be configured to allow housing 62 to be rotated and pivoted in any direction desired for illumination from lamp 64. If desired, light fixture housing 62 can include a pressure relief valve 66 of the type that provides a sealed light fixture, as described in U.S. Pat. No. 6,254,258 (U.S. Pat. Nos. 6,161,948 and 6,254,258 are both owned by the assignee of the present invention). Other than locating the lamp 64 above the faceplate 20, shown level with the ground surface 68, and replacing the aiming bracket 32 with housing 62, the fixture 56 is configured the same as fixture 10 shown in FIGS. 1 and 7, particularly with regard to barrier plate 12. The fixture housing 116 shown in FIG. 9, is also configured the same except that junction box 16 is located on the side of primary housing 18 with the barrier plate 12 vertically placed inside primary housing 18.

The hydrological barrier plate 12, best shown in FIGS. 2, 3, 5, and 6, is the primary sealing mechanism to seal junction box 16 from the primary housing 18 of housing 14. Although it is desirable and intended that no water be able to enter junction box 16, most light fixture manufacturers still design their light fixtures with the idea that when the fixture is in use a dry junction box 16 is difficult, if not nearly impossible, to maintain (for the reasons set forth above). This is particularly the situation as most manufacturers do not have their own people performing the installation of the light fixtures. Instead, most light fixtures 10 are installed by persons (i.e., subcontractors) that have no direct relationship with the manufacturer. As such, manufacturers typically design their light fixtures with the belief that water will likely enter the junction box (lower housing) 16 area through the conduit, at the conduit connection or elsewhere. The hydrological barrier plate 12 of the present invention prevents any water that may enter the junction box 16 from migrating upwards or across to primary housing 18.

A preferred embodiment of the hydrological barrier plate 12 of the present invention, as shown in FIG. 2, has plate body 70 having a first side 72 and a second side 74. Plate body 70 can be manufactured out of stainless steel, aluminum, certain high strength plastics (such as General Electric's NORYL® products), various composite materials or other materials that are of sufficient strength and which are sufficiently temperature and corrosion resistant to operate as described below in the conditions normally associate with fixtures 10, 56 and 116. Plate body 70 is sized and configured to fit inside primary housing 18 of housing 14 and allow second side 74 to abut against first plate ledge 76 located inside housing 14, as best shown in FIG. 3. First plate ledge 76 can be a raised portion of the housing 14 inside the primary housing 18 or junction box 16 itself. Alternatively, first plate ledge 76 can be the area around the opening where the barrier plate 12 will be positioned. As shown in FIGS. 2 and 3, second side 74 has a seal receiving portion 78 configured to receive a sealing member, such as o-ring 80 therein. When the barrier plate 12 is in place inside housing 14, sealing member 80 will sealably abut against the inside of wall 42 to seal the outer edge of plate body 70 so as to prevent fluid from moving from junction box area 16 to the upper compartment 18 by going around the outside of barrier plate 12. Unlike prior art devices, sealing member 80 will be in radial compression against housing 14. As known in the art, various o-rings may be appropriate for sealing member 80. The preferred o-ring 80 is a high temperature silicone o-ring. If desired, a lower lip 82 on second side 74 of plate body 70 can be sized and configured to abut against second plate ledge 84 when barrier plate 12 is in place inside housing 14.

To assist in placing and removing barrier plate 12 from inside housing 14, the preferred embodiment of the barrier plate 12 has handle 86, shown in FIG. 2. In the preferred embodiment, handle 86 pivotally connects to the inside of an indented section 88 (best shown in FIG. 5) of first side 72 to permit the handle to be pivoted in an upward position when it is desired to place or remove barrier plate 12 and pivoted back to a downward position when assembling light fixture 10 or 56 of the present invention.

Figure 5:
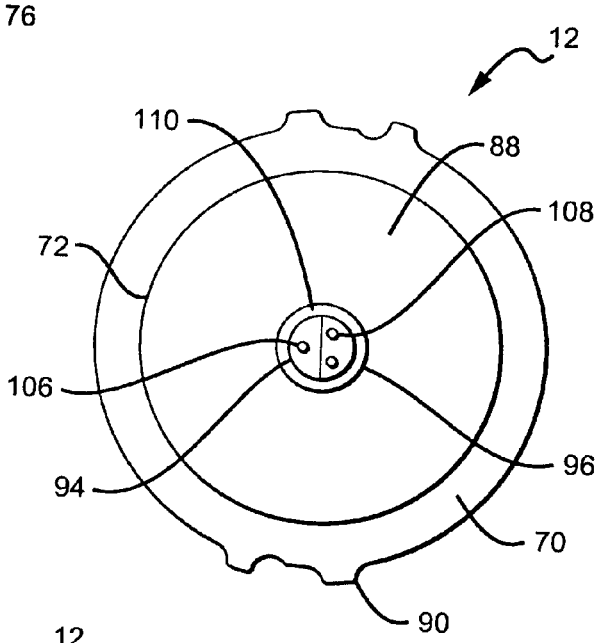
FIG. 5 is a top view of the hydrological barrier plate of the present invention without the handle component.
Figure 6:
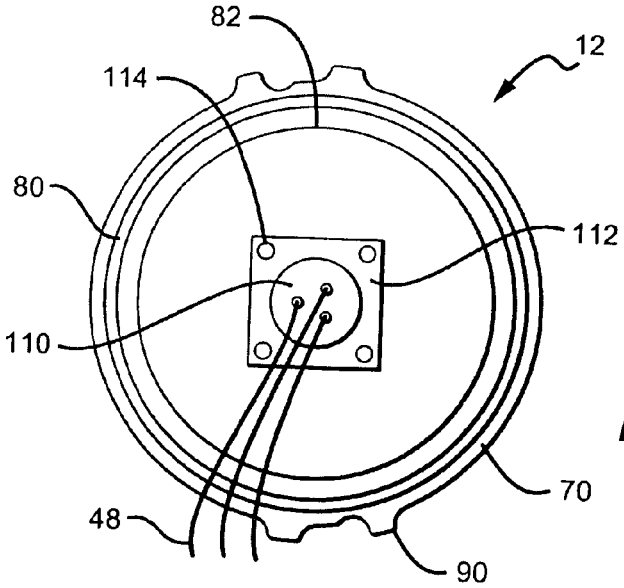
FIG. 6 is a bottom view of the hydrological barrier plate of the present invention.

To effectively prevent water or other fluids from migrating between the junction box 16 and primary housing 18, barrier plate 12 must be secured inside housing 14 in a manner that seals the outer edge 90, as shown in FIGS. 5 and 6, to the inside wall of housing 14 to isolate junction box 16 from primary housing 18. In this embodiment, the mere act of pushing the barrier plate 12 into place will effectuate a seal, due to the radial compression of sealing member 80 against housing 14. As such, the seal between junction box 16 and -primary housing 18 is nearly "fail-safe" and can be accomplished without the use of any tools. This avoids problems with contractors and others having to be careful to properly and completely attach the prior art cover plates to the housing in order to obtain the axial compression necessary for a seal. Due to the ease of installation, the person installing barrier plate 12 will essentially be forced to at least press it into place, which will provide a minimum acceptable sealing arrangement. Tests by the inventors have indicated that a properly sized sealing configuration between the barrier plate 12 and housing 14 can result in a seal capable of withstanding approximately three feet of hydraulic pressure.

In another embodiment of the present invention, outer edge 90 of first side 72 can be shaped and configured to cooperate with one or more pins 92 on first plate edge 76 to make sure that barrier plate 12 will be locked into place. As is known in the art, pin 92 can have a portion (often enlarged relative to the rest of pin 92) that is raised above the surface of first plate edge 76 so that the outer edge 90 of first side 72 can be rotated under pin 92 by using handle 86. In this embodiment, the shaped portion of outer edge 90 should be configured to slide under pin 92 when barrier plate 12 is placed in or removed from housing 14 and be held in place by pin 92 when rotated in a manner that locks barrier plate 12 in housing 14. Any pressure from inside junction box 16 that would attempt to dislodge barrier plate 12 from its position should be sufficiently overcome by the force of pins 92 holding barrier plate 12 in place.

In one configuration, discussed in more detail below and shown in FIG. 9, the barrier plate 12 can be a solid plate that prevents flow of fluid from one side of barrier plate 12 to the other side. In many circumstances, however, the system will be configured to allow electricity to flow from one side of barrier plate 12 to the other to power the electrical components, including lamp 30. In order to allow the electrical flow from fixture wires 48 to pass through barrier plate 12 to the primary housing 18 of housing 14, barrier plate 12 includes a pass-through valve 94 for electrically connecting the junction box 16 with the various components in the primary housing 18. In the embodiment shown in the figures, plate body 70 has an opening 96 provided (i.e., by drilling or molding during the manufacturing of plate body 70) therethrough and the pass-through valve 94 sealably placed therein.

Pass-through valve 94 should be of the type that prevents water wicking between junction box 16 or fixture wires 48 and primary housing 18. To effectively prevent water intrusion into primary housing 18, pass-through valve 94 must prevent water wicking on both the outside and the inside of wires 48. A pass-through valve 94 the inventors have found to be effective at preventing any wicking is the anti-syphon SURE-SEAL® connector from PEI-Genesis out of Philadelphia, Pa. This connector has a single piece molded body and crimp contacts with the appropriate number of wires 48 (i.e., three as shown) extending therefrom that has a receptacle portion 98 and a mateable plug portion 100. The first portion 102 of receptacle 96 extends into primary housing 18 from plate body 70 (as best shown in FIGS. 2, 7 and 8) and the second portion 104 of receptacle 96 extends into junction box 16 of housing 14, as best shown in FIG. 2.

In the embodiment shown in FIG. 5, the first portion 102 of receptacle 96 includes a male connector 106 and two female connectors 108. As known in the art, other configurations of receptacle 96 can be utilized. The second portion 104 of receptacle 96 comprises the one or more fixture wires 48 (three are shown). In the embodiment shown in FIG. 7, the transformer 36 includes the plug portion 100 as part of transformer 36 such that it directly plugs into first portion 102 of receptacle 98. In the embodiment shown in FIG. 8, wires are utilized to connect ballast 38 to plug 100. To complete the seal between junction box 16 and primary housing 18, a sealing member is disposed on one side of plate body 70 to seal opening 96 around receptacle 98 of pass-through valve 94. In the embodiments shown in the various figures, particularly FIG. 2, pass-through valve 94 includes a sealing member 110 disposed around receptacle portion 98 on second side 74 of plate body 70. Sealing member 110 tightly abuts receptacle portion 98 and is tightly held against second side 74 of plate body 70 by plate member 112 with one or more connectors 114. In one embodiment, sealing member 110 is made integral with receptacle portion 98 of pass-through valve 94 and four connectors 114 are used to effectively clamp sealing member 110 between plate member 112 and second side 74 of plate body 70. In the preferred embodiment, the body of pass-through valve 94 and sealing member 110 are made out of an elastomeric material suitable for the conditions in which fixture 10 or 56 will be used, such as PVC Nitrile, silicone and EPDM. If desired , a second sealing member, plate member and connectors can be utilized on first side 72 of plate body to fully encase pass-through valve 94. Alternatively, sealing member 110, plate member 112 and connectors 114 can be used only on first side 72 of plate body 70 (as opposed to second side 74 or both sides). In addition, adhesives can also be used to place pass-through valve 94 in barrier plate 12 or a sealing compound could be applied to opening 96 on first side 72 of plate body 70 to seal in pass-through valve 94.

A different configuration for a light fixture 116 having housing 14 is shown in FIG. 9. The housing 14 for this type of fixture has junction box 16 attached to the side of primary housing 18. As stated above, first plate ledge 76 can be raised above the remaining housing 14 or it can be the area around the opening in primary housing 18 where the barrier plate will be placed. If desired, the bottom 44 of primary housing 18 can comprise one or more flow openings 118 that allows water to flow through the primary housing 18, as opposed to being designed to keep water out. Use of this type of fixture 116, often referred to as having a "flow through" housing, requires the electrical components in the primary housing 18 to be water sealed so they or other components of the fixture 116 are not damaged by the in/out flow of water. In this configuration, the water that flows through the primary housing 18, as well as other water, is desired to be kept out of junction box 16. As shown in FIG. 9, barrier plate 12 is positioned against first plate ledge 76 located on the side of primary housing 18 to seal the interface between primary housing 18 and junction box 16. This barrier plate 12 should comprise a pass-through valve 94 in the opening (not shown) in barrier plate 12 to allow the electrical current to pass from the junction box 16 but not any water, as described above with fixtures 10 and 56. As shown, junction box 16 can comprise a second barrier plate 120 that does not have a pass-through valve. Although second barrier plate 120 can be located on the top, bottom or one of the sides of junction box 16, it will generally be on the top of junction box 16 to allow access to the interior of junction box 16 from above. Second barrier plate 120 is configured and functions the same as barrier plate 12 discussed above, except as to that part of the discussion pertaining to the pass-through valve. If desired, however, a pass-through valve can be placed in second barrier plate 120 also.

In use, a hole is dug to the appropriate depth and width dimensions for housing 14 of light fixture 10, 56 or 116. The conduit is typically connected to housing 14 at either the side attachment locations 52 or the bottom conduit entries 54. The power wires 46 are brought into the junction box 16 of housing 14 for connection to the fixture wires 48 using connectors 50, preferably of the "waterproof" type described above. After the appropriate connections are made, the handle 86 of barrier plate 12 is pivoted to an upward position so that barrier plate 12 can be placed in housing 14 to seal off (i.e., hydrologically isolate) junction box 16 from primary housing 18. Barrier plate 12 is placed into primary housing 18 such that second side 74 of plate body 70 abuts first plate ledge 76 and second plate ledge 84. Utilizing handle 86, the installer pushes second side 74 of barrier plate into position to obtain the radial compression of sealing member 80 against. housing 14. As stated above, no tools are needed to accomplish this and the horizontal compression against sealing member 80 will obtain the desired seal. If pins 92 are used, the installer will first rotate barrier plate 12 so that the shaped outer edge 90 of barrier plate 12 is properly aligned with pins 92 in order to abut it against first 76 and second 84 plate ledges. The installer then applies a force to barrier plate 12 and rotates it in the appropriate direction so that outer edge 90 is able to slide underneath pins 92 on the first plate ledge 76 and be held tightly in place by pins 92. Handle 86 is then moved to the downward position.

Utilizing the barrier plate 12 in a housing 14 of the present invention, all available water paths between junction box 16 and primary housing 18 are blocked. Water on the outside of the power wires 46 will be blocked by the anti-syphon pass-through valve 94 having the pin contacts being placed on the inside. Any water trying to wick up the inside of power wires 46 will also be stopped by valve 94. Water attempting to enter primary housing 18 by way of opening 96 will be blocked by sealing member 110 and plate member 112. The o-ring 80, in conjunction with the twist locking of barrier plate 12 if used, will prevent any water from passing into the primary housing 18 around the outer edge 90 of barrier plate 12.

In another alternative embodiment of fixtures 10, 56 or 116 of the present invention, the fixtures could incorporate a disconnect switch (not shown) in the area where barrier plate 12 is positioned inside housing 14. Preferably, the disconnect switch would be configured to prevent the flow of electricity from power wires 46 until and unless barrier plate 12 is properly and effectively installed in place by the contractor/subcontractor installing light fixture 10, 56 or 116. This configuration improves the present invention by forcing the installer to properly place and, if desired, twist barrier plate 12 into position in housing 14, thereby preventing the careless or lazy installer from failing to properly place barrier plate 12 in housing 14.

While there is shown and described herein certain specific alternative forms of the invention, it will be readily apparent to those skilled in the art that the invention is not so limited, but is susceptible to various modifications and rearrangements in design and materials without departing from the spirit and scope of the invention. In particular, it should be noted that the present invention is subject to modification with regard to the dimensional relationships set forth herein and modifications in assembly, materials, size, shape and use.

I claim:

1. An apparatus using a hydrological barrier plate, comprising:

a hollow housing with a housing wall;

a first plate ledge and second plate ledge, each disposed on the inner side of said housing wall;

a plate body having a first side, a second side having a lower lip, an outer edge and a seal receiving portion disposed between said first side and said second side, said outer edge and said lower lip seated on said first plate ledge and second plate ledge, respectively; and at least one sealing member disposed in said seal receiving portion of said plate body, said at least one sealing member configured to sealably interact with said housing wall when said outer edge of said plate body abuts said plate ledge; and an opening in said plate body and a wire pass-through valve, said opening interconnecting said first side and said second side of said plate body, said pass-through valve comprising a receptacle portion and a mateable plug portion, at least a portion of said pass-through valve sealably disposed in said opening.

2. The hydrological barrier plate according to claim 1, wherein said receptacle portion is sealably disposed in said opening and said mateable plug portion is removable from said receptacle portion.

3. The hydrological barrier plate according to claim 1, wherein said pass-through valve has a first portion and a second portion, said first portion extending above said first side of said plate body and said second portion extending below said second side of said plate body.

4. The hydrological barrier plate according to claim 3, wherein said receptacle portion is disposed in said first portion.

5. The hydrological barrier plate according to claim 4, wherein said second portion of said pass-through valve has one or more wires extending therefrom, said wires configured for attachment to a supply of electrical power.

6. The hydrological barrier plate according to claim 1, wherein said pass-through valve further comprises a second sealing member and a plate member.

7. The hydrological barrier plate according to claim 6, wherein said plate member is configured to sealably abut said second sealing member against said plate body.

8. The hydrological barrier plate according to claim 7 further comprising one or more connectors configured to connect said plate member to said plate body.

9. The hydrological barrier plate according to claim 6, wherein said second sealing member is configured to be integral with said pass-through valve.

10. The hydrological barrier plate according to claim 1 further comprising a handle attached to said plate body.

11. The hydrological barrier plate according to claim 1, wherein said at least one sealing member is an o-ring.

12. A housing for use with light fixtures, comprising:

a primary housing compartment;

a junction box connected to said primary housing, said junction box configured to receive one or more electrical wires connected to a source of electrical power; and a hydrological barrier plate disposed in said housing between said primary housing compartment and said junction box, said hydrological barrier plate comprising a plate body having an opening therethrough, a wire pass-through valve sealably disposed in said opening and electrically coupled to one or more fixture wires, and a seal receiving portion having at least one sealing member disposed therein, said at least one sealing member sealably interacting with said housing to prevent fluid flow between said primary housing and said junction box.

13. The housing according to claim 12, wherein said pass-through valve further comprises a first portion and a second portion, said first portion having a receptacle extending from a first side of said plate body, said second portion having said one or more fixture wires extending from a second side of said plate body, said fixture wires configured for attachment to said one or more electrical wires.

14. The housing according to claim 12, wherein said pass-through valve further comprises a second sealing member and a plate member, said plate member configured to sealably abut said second sealing member against said plate body.

15. The housing according to claim 14 further comprising one or more connectors configured to connect said plate member to said plate body.

16. The housing according to claim 14, wherein said second sealing member is configured to be integral with said pass-through valve.

17. The housing according to claim 12 further comprising a handle attached to said plate body.

18. The housing according to claim 12, wherein said at least one sealing member is an o-ring.

* * * * *